US006659377B1

(12) United States Patent
Coulter et al.

(10) Patent No.: US 6,659,377 B1
(45) Date of Patent: Dec. 9, 2003

(54) APPARATUS FOR DISENGAGING INSULATION MATERIAL FROM BALES FOR BLOWING AND METHOD THEREFOR

(75) Inventors: Jack D. Coulter, Winter Haven, FL (US); Robert A. Wright, Auburndale, FL (US)

(73) Assignee: CertainTeed Corporation, Valley Forge, PA (US)

( * ) Notice: Subject to any disclaimer, the term of this patent is extended or adjusted under 35 U.S.C. 154(b) by 0 days.

(21) Appl. No.: 09/605,345

(22) Filed: Jun. 28, 2000

Related U.S. Application Data

(63) Continuation-in-part of application No. 08/885,521, filed on Jun. 30, 1997, now Pat. No. 6,088,968.

(51) Int. Cl.[7] ..... B02C 19/12

(52) U.S. Cl. ..... 241/60; 241/236; 241/295; 241/605

(58) Field of Search ..... 52/64; 241/605, 241/236, 60, 295

(56) References Cited

U.S. PATENT DOCUMENTS 2,903,193 A * 9/1959 Anderson
4,411,390 A * 10/1983 Woten ..... 241/605
6,088,968 A * 7/2000 Williston et al. ..... 52/64

FOREIGN PATENT DOCUMENTS

GB 2072352 * 9/1981
GB 2099776 * 12/1982

* cited by examiner

*Primary Examiner*—Mark Rosenbaum
(74) *Attorney, Agent, or Firm*—Stevens, Davis, Miller & Mosher, LLP

(57) ABSTRACT

An apparatus and a method for installing insulation from bound insulation bales having a feeder for contacting and moving the insulation bales and a receiving apparatus for disengaging the insulation from unbound bales. A cutter disengages insulation from the insulation bales and has at least one vertically arranged member rotatable about a vertical axis toward which the bales are moved and also has a circumference upon which is vertically positioned a plurality of blades extending radially outwardly from said circumference for severing the insulation away from the bales. An air blower blows the insulation out from said system onto a surface to be insulated. A method for installing insulation from bound insulation bales including supporting the bound insulation bales for longitudinal movement, unbinding the bound insulation bales, moving the unbound insulation bales for contact with vertically arranged cutters, selecting the sizing of the insulation by vertically spacing the cutters, sizing and disengaging the insulation from the unbound insulation bales and directing the insulation into an air blower for dispensing said insulation.

27 Claims, 6 Drawing Sheets

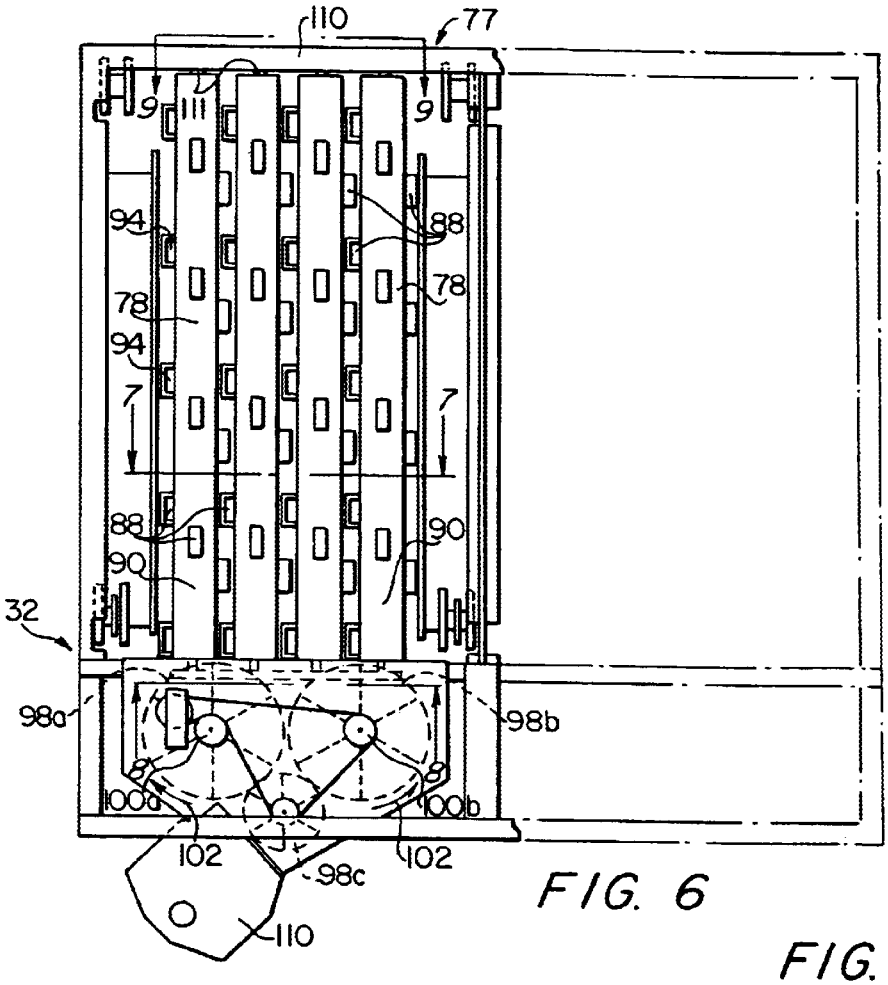
FIG. 6
FIG. 8
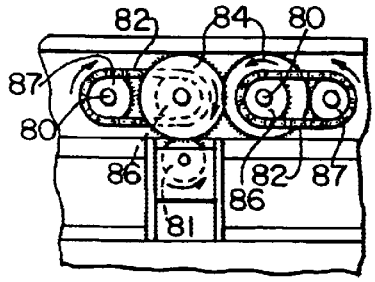
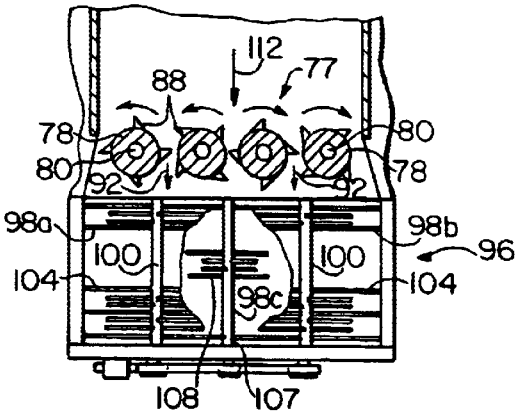
FIG. 7
FIG. 9
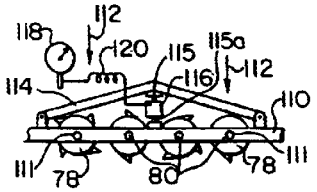

APPARATUS FOR DISENGAGING INSULATION MATERIAL FROM BALES FOR BLOWING AND METHOD THEREFOR

This application is a continuation in part of application Ser. No. 08/885,521, filed Jun. 30, 1997, now U.S. Pat. No. 6,088,968, issued Jul. 18, 2000.

BACKGROUND OF THE INVENTION

This invention relates generally to an apparatus and method for providing insulation materials in a simple economical manner for being applied to buildings or other structures. More particularly, the present invention is concerned with an apparatus and method for the economical and efficient application of particulate insulation materials from bales of insulation to the surfaces of buildings or other structures by pneumatically blowing or spraying such particulate insulation materials.

The types of insulation materials with which the present invention is concerned include generally but not exclusively fibers such as granulated rock wool, granulated mineral fiber wool, glass fiber materials, cellulose fibers, expanded mica, etc. This insulation material may be in particulate form and may be either blown dry or sprayed through a nozzle with liquid added to form an insulation and sealing coating on any surface. The insulation material has been blown on conventional walls and ceilings of places of habitation or working areas but also may be sprayed on any other surface as desired.

The insulation material used in conventional insulation spraying and blowing machines is typically in a relatively loose condition though usually packed under high compression in bags or sacks for shipment to the user. Upon being opened, these bags or sacks are typically manually emptied into the receiving hopper of a conventional insulation spraying and blowing machine. Prior U.S. Pat. No. 4,411,390 issued to Homer G. Woten recognizes the problems occurring from compressed masses of insulation material that normally would render the insulation material difficult to use in conventional apparatus that requires feeding through an air hose to a dispensing nozzle. To reduce these large masses, which may include nodules of the insulation material, separation into particulate form must be accomplished, although the insulation material may be to some extent mutually entwined and not be discreet. The term "particulate" as used hereinafter must be understood to include not only particles but also one or more intertwined or overlapping fibers and for convenience the term "particulate material" will therefore include materials formed as particles as well as fibers. These problems presented by the compacted materials have been overcome by the aforementioned patent as well as others held by the same patentee and owned by CertainTeed Corporation including U.S. Pat. No. 3,085,834 and U.S. Pat. No. 3,529,870.

To apply these insulation materials not only in particulate form as discussed above but also economically and efficiently, the desirable insulation blowing apparatus would be on a wheeled vehicle for convenience and economy of application. This necessitated a continuous supply of insulation filled bags or sacks with the insulation being emptied into the hopper of the insulation blowing machine. Because such hoppers had relatively limited capacity, continuous attention by an on site worker must be had to retrieving, opening and emptying the bags or sacks of insulation into the hopper and then disposing the bag or sack. Typically, that would be almost a full time occupation for such worker while a fellow co-worker was applying the insulation at the nozzle end of the hose attached to the blower. Such labor intensive operations have been found to be uneconomical and time consuming and therefore it would be desirable to have only a single operator at the nozzle end for applying the insulation while there is a continuous and more than adequate supply of insulation material always available for the blowing apparatus.

U.K. patent application GB 2072352A published Sep. 30, 1981, but later withdrawn, has attempted to meet some of the concerns of the prior art by incorporating the use of bales that are loaded onto the side of a truck that possesses a moving floor structure to carry the bales towards a conventional blower for dispensing the insulation. The bales and the means of banding, if any, are not otherwise identified but are nevertheless said to be urged by the moving floor towards the hopper of the conventional insulation blower where the bales are alleged to be broken up so that the insulation can be blown out through the hose attached to the blower. No conventional blowing apparatus could receive any tightly compacted bale of insulation material and efficiently and economically generate particulate material necessary for entering the blowing apparatus. Accordingly, it is believed that this attempt to provide the necessary supply of insulation material to the blowing apparatus would not achieve its purpose because either the bales would be too loose and fall apart before loading or if tightly compacted would take a long time to be broken up by conventional blowing apparatus into necessary particulate form. Thus in either case, this described process would produce, if not inoperative, an unsuccessful and uneconomical insulation blowing technique.

Accordingly, it is the principal object of the present invention to provide for the continuous supply of baled insulation material to a unique insulation bale receiving apparatus that disengages the insulation from the bale so that it may be accepted by and dispensed through a conventional air blower onto a surface to be insulated.

Another object of the invention is to provide an apparatus that disengages the insulation from the bale with minimal use of hydraulic power while sizing the disengaged insulation for subsequent dispensing through a conventional air blower.

SUMMARY OF THE INVENTION

A system and a method for installing insulation from bound insulation bales in which the bales are supported on an elongated base with surrounding stationary side walls where the straps binding the bales may be removed through strap removal doors. At least one movable wail that is positioned between the side walls and transversely to the base continually moves the unbound insulation bales by a drive means toward a dispensing end of the base where shredding of the insulation from the unbound insulation bales occurs. The shredding is accomplished by a plurality of picker drums rotating about adjacent vertical axes supported and journaled by a cross bar extending above and athwart the base. Each of the picker drums has positioned on the circumference a plurality of cutter blades that cut and saw the insulation while controlling the sizing of the insulation as it is disengaged from the unbound bales, permitting the sized insulation to fall into a blender wherein the insulation material is formed into particulate material and then cast into an air blower formed with the hose and nozzle for dispensing the blowing material.

THE DRAWINGS

Figure 1:
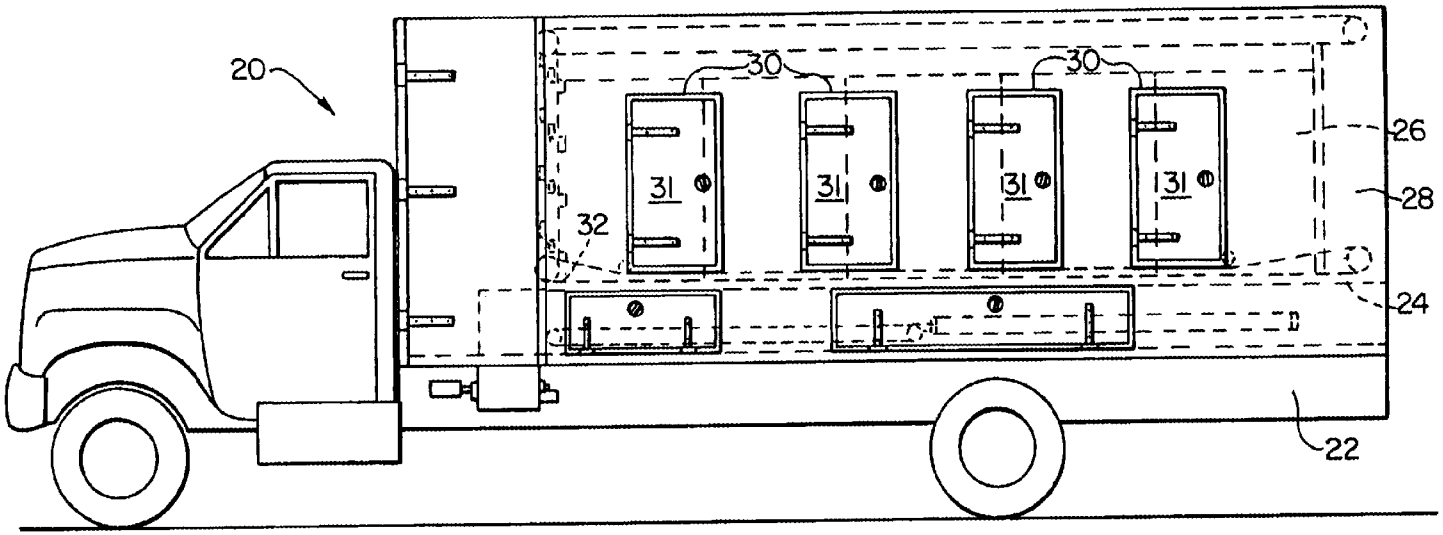
FIG. 1 is a side elevational view of the vehicle having thereon the baled insulation blowing apparatus of the present invention and illustrating the side walls and the side doors therein for strap removal from the bales and also showing the outlet from the air blower.
Figure 4:
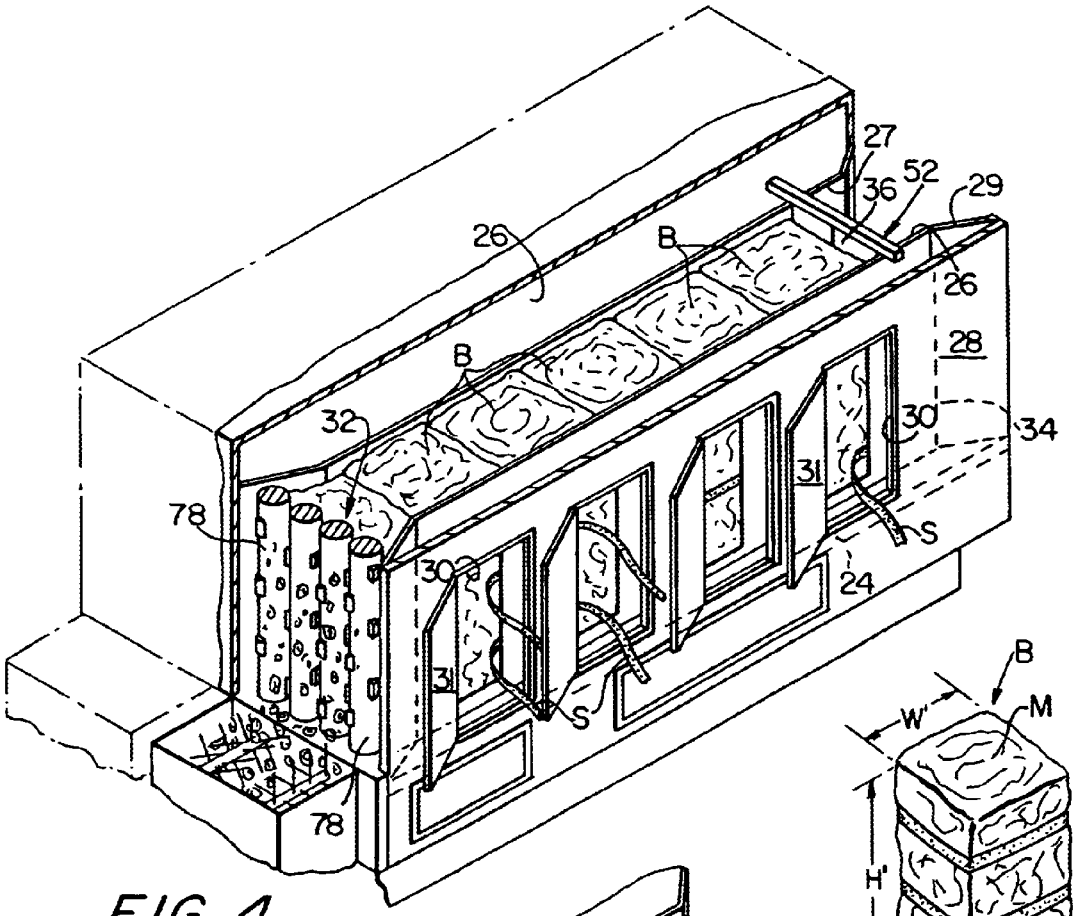

FIG. 4 is a perspective view partially cut away and partly in phantom lines illustrating the same left side of the vehicle as in FIG. 1 wherein the bales are illustrated to have been loaded onto the base of the vehicle and the strap removal doors open to reveal the straps surrounding the bales being partially removed. Also shown are the vertically positioned picker drums abrading the bales of insulation material to have it fall into the blender.

Figure 5:
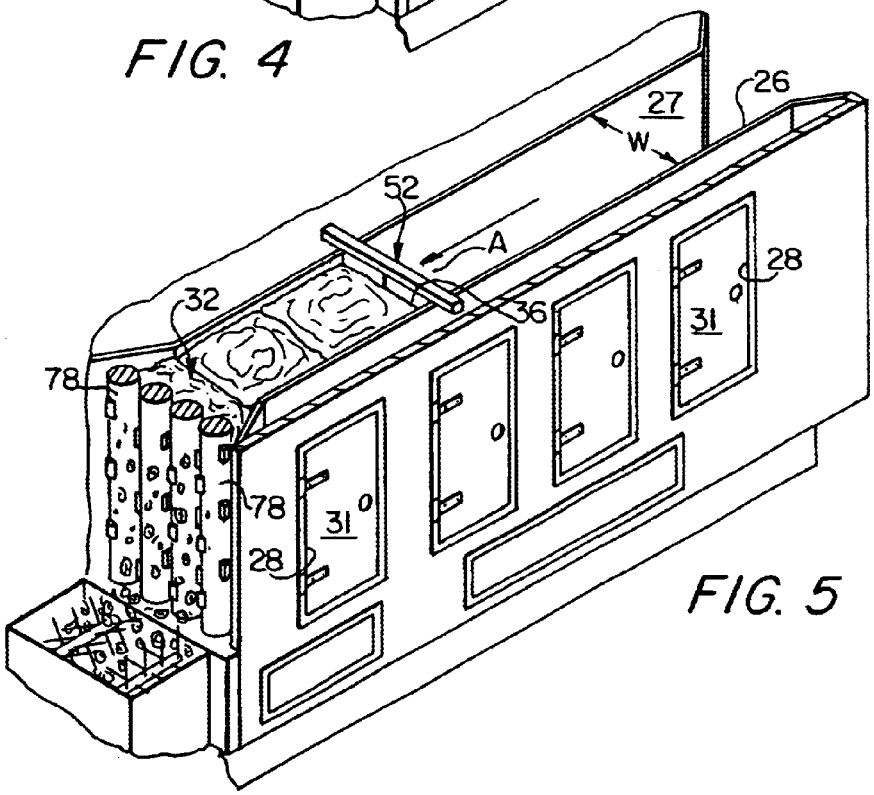

FIG. 5 is a perspective view partly broken away and similar to the showing of FIG. 4 but illustrating the movement of the movable wall forcing the unbound bales of insulation material toward the bale receiving end that includes an initial form of the rotating picker drums.

FIG. 6 is a front elevational view of the left side of the vehicle embodying the insulation blowing system of the present invention with the identical opposite right side shown in phantom lines. In dotted lines are shown the three blenders while the air lock forming the air blower with outlet can also be seen.

FIG. 7 is a cross sectional view partly broken away and taken along lines 7—7 of FIG. 6 illustrating the rotation an initial form of the picker drums and also illustrating the several blenders and the cooperation of the various axes of rotating fingers.

FIG. 8 is a view partly broken away and taken along lines 8—8 of FIG. 6 to illustrate the gear arrangement for the rotation of the picker drums.

FIG. 9 is a view taken along lines 9—9 of FIG. 6 and partly broken away illustrating the force measurer and the strain gauge connection to the controller of the drive means forming the force urging the movable walls and the bales of insulation toward the shredder.

Figure 10:
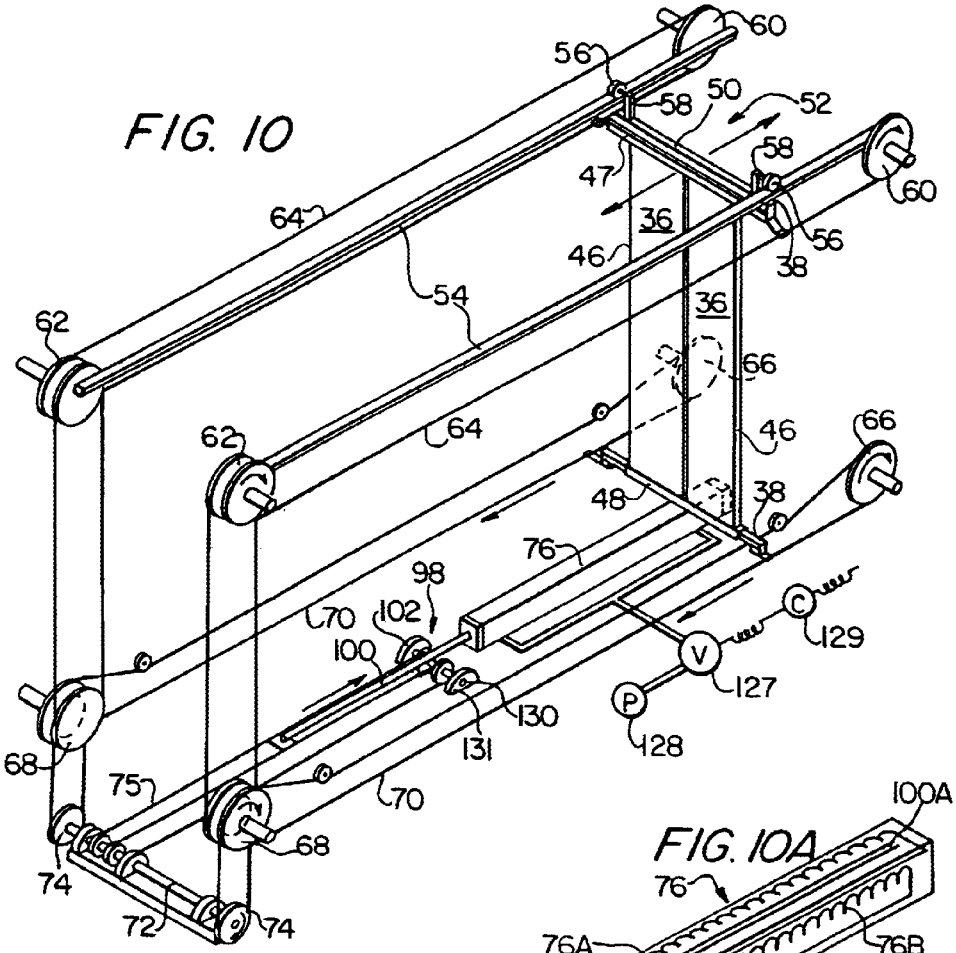

FIG. 10 is a schematic skeleton view of the drive system for one pair of movable doors forming the movable wall including the interconnecting chain system, the ram drive means for operating the chains, and the gear arrangement that is cooperatively associated with the ram to actuate the electronic means for determining and monitoring the amount of insulation dispensed by the system and that may in turn otherwise control the dispensing of insulation material by the system based on various pre-selected parameters.

Figure 10A:
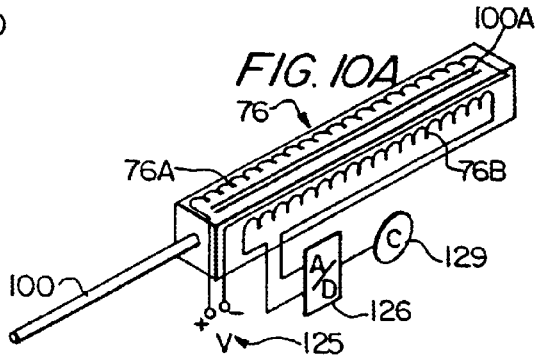

FIG. 10A is a diagram illustrating linear voltage differential transformer embodiment of a position transducer.

Figure 10C:
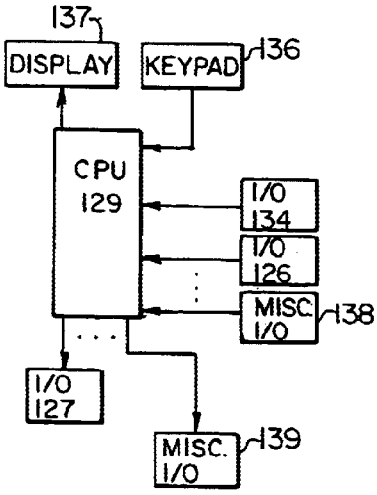
Figure 10B:
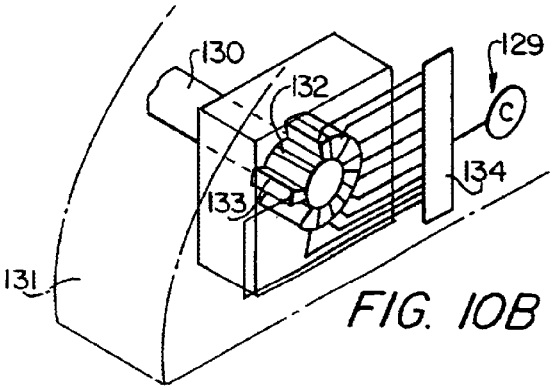

FIG. 10B is a diagram illustrating a rotary encoder embodiment of a position transducer.

FIG. 10C is a block diagram illustrating the signal receiving means of the present invention embodied in a computer and associated peripherals.

Figure 11:
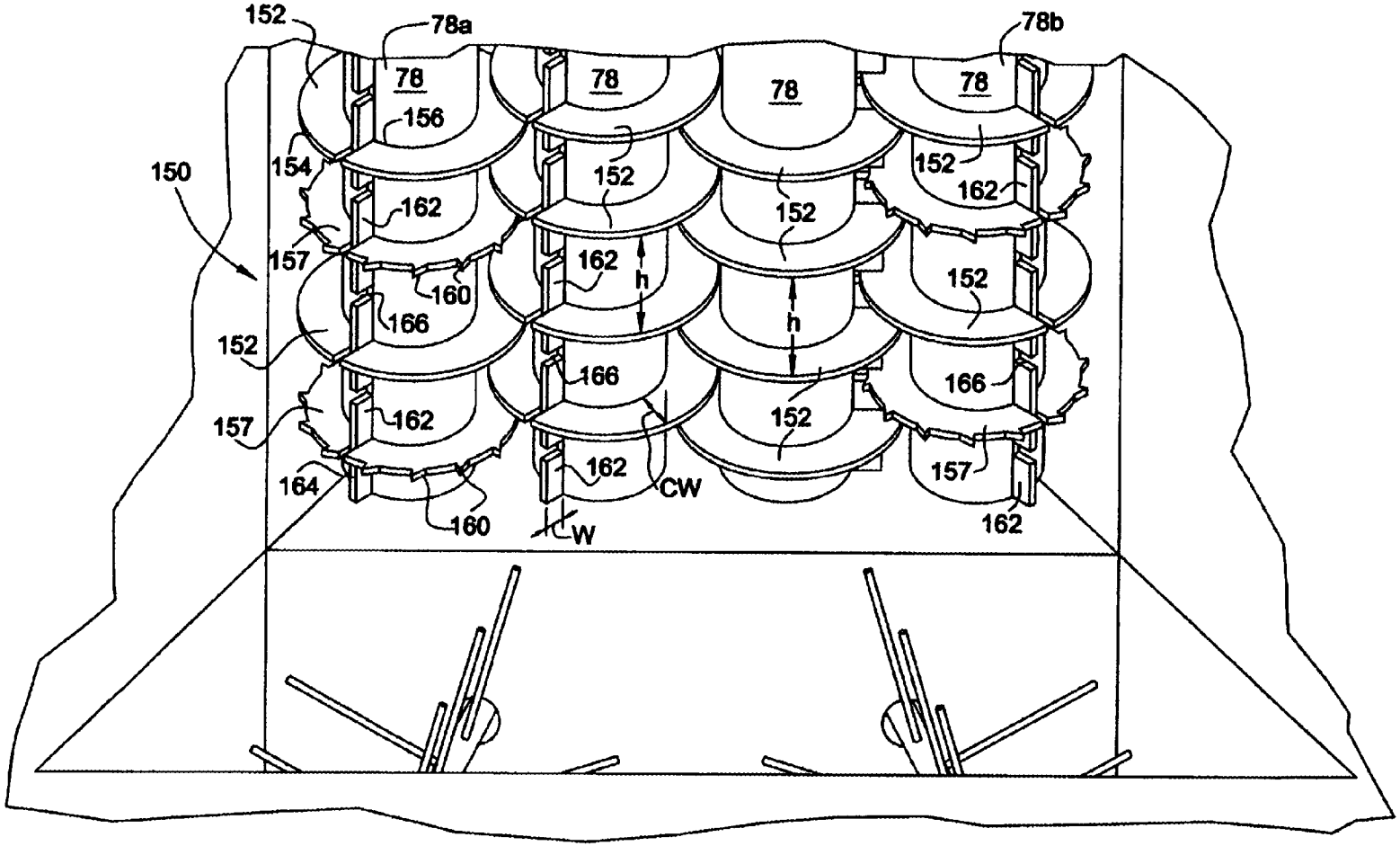

FIG. 11 is a side elevational view in perspective partly broken away of the vertically arranged cutters positioned circumferentially around the rotatable drums and illustrating both the saw teeth for sawing the insulation and the cutting edges of the cutting rings for slicing the insulation from the unbound insulation bales.

Figure 12:
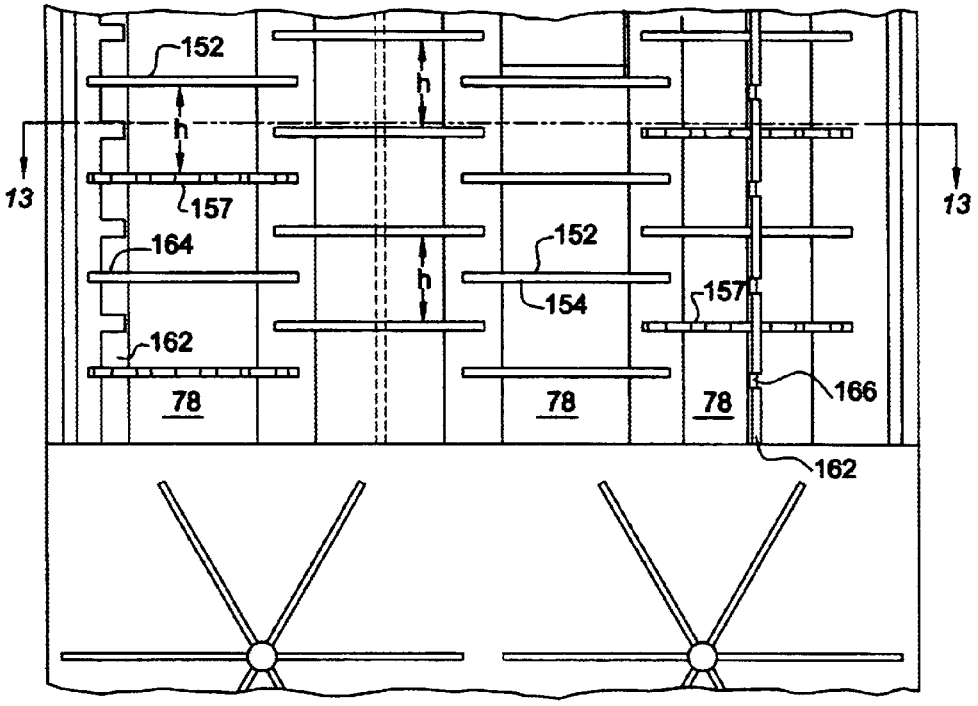

FIG. 12 is a side elevational view partly broken away of FIG. 11.

Figure 13:
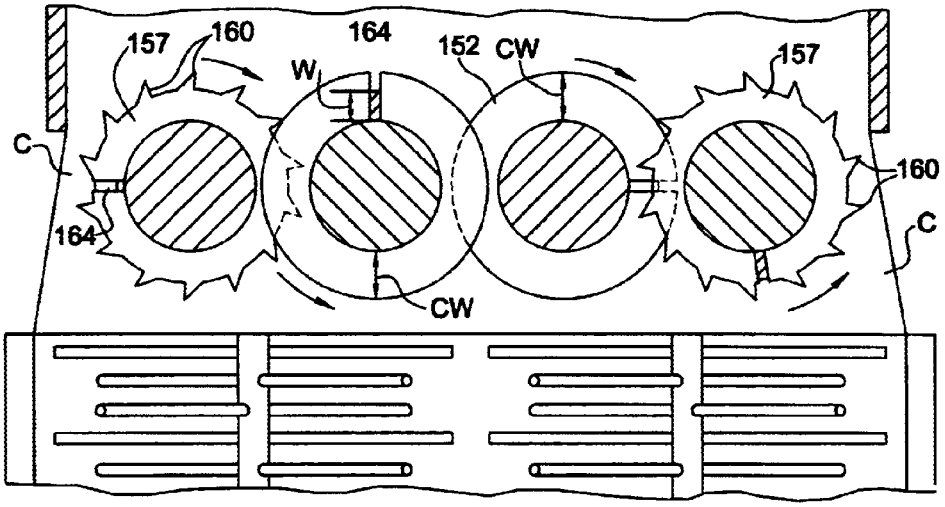

FIG. 13 is a cross-sectional view taken along lines 13—13 of FIG. 12.

DESCRIPTION OF THE PREFERRED EMBODIMENT

FIG. 1 discloses at 20 the wheeled vehicle in the form of a truck representative of the present invention. The truck 20 includes a chassis 22 on which is positioned an elongated flat horizontal base 24 shown in phantom lines in FIG. 1 but also shown in the end view of the truck at 22 of FIG. 2. The truck as best shown in FIGS. 1 and 2 and 4 and 5, includes an inner area A having outer wall 26 and an inner wall 27 that extends the length of the base 24. Outside walls 28,28 form the outermost boundaries of the truck 20 and are connected to each outer wall 26 by connecting wall 29. Outer wall 26 is provided with a plurality of openings 30 that receive doors 31 suitably hinged at 38, as shown in FIGS. 10 and 11, for opening and closing to gain admittance to area A between the walls 26 and 27 as best shown in FIG. 5.

Figure 2:
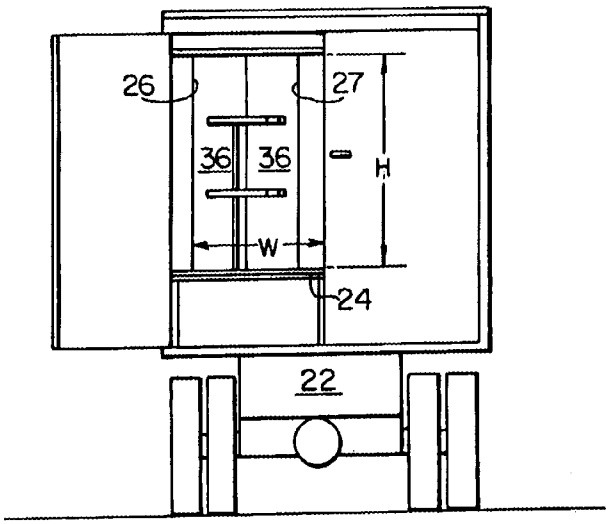
FIG. 2 is an end elevational view of the vehicle at FIG. 1 with the rear door open and illustrating only the left side of the interior of vehicle and a pair of the movable doors forming the movable wall with accompanying latches to keep the doors closed. The right hand side interior is identical to the left hand side.
Figure 3:
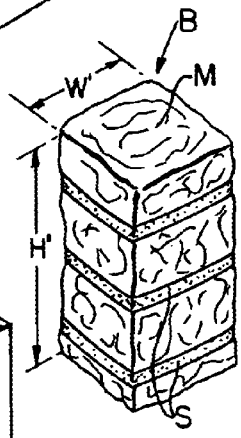
FIG. 3 is a perspective view of a typical bale of insulation material illustrating the plurality of straps surrounding the insulation forming the bale.

The area A has a width W and height H as shown in FIGS. 2 and 5. The height H may be 1–3 times or more the height H' of the bale B while the width W corresponds very roughly to the width W' of the bale B of the insulation material H as shown in FIG. 3. The insulation material H is bound into the shape of the bale by a plurality of straps S that surround the bale B to form a bound bale of insulation material as shown in FIG. 3. The bales are loaded onto the base 24 as shown in FIGS. 2, 4 and 5. A truckload of bales B can be expected to constitute a full day's supply for an on site blowing job.

The bales B are urged by a controllable force towards the dispensing end 32 as shown in phantom lines in FIG. 1 and in solid lines in FIG. 5. At the opposite or distal end 34 of the base the bales B are loaded through a pair of movable doors 36.

As shown in FIG. 10, doors 36 are hinged at suitable pivot points 38 so that the individual doors 36, 36 open when suitable latch members (not shown) are manipulated to unlock doors 36, 36. The doors 36, 36 swing outwardly away from the base 24 which is then ready for loading of the bales B in their bound form with the straps as shown in FIG. 3.

The movable doors 36, 36 are held in a support structure including upright bar members 46, 46 on the outer pivot side of the doors 36, 36 and are supported by horizontal upper 47 and lower 48 support members. Top support member 50 as shown in FIG. 10 provides support for the pivoting doors 36, 36 about pivots 38. The movable doors 36, 36 may be referred to in unitary form as movable wall 52, which includes the pivoting and movable doors 36, 36 as well as the upper 47 and lower 48 support members.

As shown in FIG. 10, movable wall 52 is suitably supported by a pair of parallel rails 54,54 upon which movable wall 50 travels through the use of suitable rollers 56,56 that are each secured to vertical extension arms 58,58 connected to and protruding upwardly from the top support member 50.

A system of pulleys including those upper pulleys 60,60 at one end and those at the bale receiving end 32 as shown at 62,62 operate with corresponding chains 64,64 to pull the movable wall 52 forwardly or rearwardly.

A similar pulley and chain arrangement at the bottom of the movable wall 52 is shown at pulleys 66,66 at one end and 68,68 at the other end operating with chains 70,70 to operate in unison with chains 66,64 and their corresponding pulleys. Driveshaft 72 and accompanying pulleys 74,74 are operated through chains 75,75 by hydraulic ram 76, powered by conventional hydraulic pump P and controlled by valve V operated by controller C for purposes to be described hereinafter.

One embodiment of the dispensing end 32 toward which the movable wall 52 forces the unbound bales of insulation material is shown in FIGS. 4, 5, 6 and 7 particularly. This first embodiment includes a shredder 77 having a plurality of picker drums 78 that are shown only for illustrative purposes to be four a number in the drawings. However the number of such picker drums 78 is not critical and could be more or less than the four shown. Each picker drum is rotated about its own vertical axis 80 through drive gear 81 (power source not shown) and by a combination of a series of conventional endless chains 82,82 rotated by large gears 84,84 and small gears 86,86 integral with the large gears to in turn rotate independent gears 87,87 by the connected chains 82,82, so that the gears and therefore the picker drums 78 rotate in the direction shown by the arrows in both FIGS. 7 and 8.

In this first embodiment, the picker drums 78 are provided on their circumference with a plurality of abraders or scoops 88 that protrude from the circumference 90 of each of the picker drums 78. The picker drums 78 perform a shredding or abrading function on contact with the unbound bale of insulation material H. As the drums 78 rotate, as shown in FIG. 7, the insulation material is torn off the bale in clumps or chunks and forced forwardly in the direction of the arrows 92,92. The abraders or scoops 88 preferably each have a concave surface 94 facing in the direction of rotation of the picker drums 78 that scoops the insulation material as it abrades the material from the unbound bale and directs it into the blending section 96 having a plurality of blenders including an upper pair of blenders 98*a* and 98*b* and a lower blender 98*c*. The upper pair of blenders 98*a*,98*a* as best shown in FIGS. 6 and 7, rotate about axes 100*a* and 100*b* respectively in opposite directions as shown by the arrows 102 to receive the chunks or clumps of torn off or abraded insulation material from the unbound bales. The blenders 98*a* and 98*b* rotating about the respective axes 100*a*, 100*b* break up the chunks or clumps of insulation material that may contain nodules or other groupings of the insulation material. As the radial fingers 104 rotate at high fingertip speed, the nodules are broken up to form particles of particulate material. It is preferable, though not necessary, that the fingers 104 of the large blenders 98*a* and 98*b* rotate about the axes 100*a*, 100*b* to achieve a tip speed within the maximum range of 250 to 4,000 inches per second. Preferably, though very much dependent upon the particular type of insulation material used, the tip speed can be in the range of 800 to 1,200 inches per second but may rise to around 2,000 or higher inches per second.

The insulation material passing through the counter rotating top two blenders 98*a* and 98*b* then is urged down to a blender 98*c* of lesser diameter but one that may be of increased tip speed rotating on axis 107. Particularly the fingers 108 of the lower blender 98*c* shown in FIG. 7 rotate at a tip speed of between 500 and 4,000 inches per second and again depending upon the type of material passing through, the tip speed for the lower blender 98*c* should be higher than the top two blenders 98*a* and 98*b*.

The blender 98*c* receives the conditioned insulation particulate material free of nodules and in the form of particles that may then pass into the conventional air lock blower 110. This air block may be of the type disclosed in above mentioned U.S. Pat. No. 4,411,390 issued to Homer G. Woten.

In order to optimize the force of the moving wall 52 in urging the unbound bales B of insulation material H towards the shredders or picker drums 78 and maintain a relatively constant force, the axes 80 of the picker drums 78, as shown in FIGS. 6 and 9 are journalled at 111 into cross bar 110. Then when the bales of insulation material move in the direction of arrows 112 (see FIGS. 7 and 9) towards the picker drums 78, any deflection of the cross bar 110 due to the force of the movement of the bales would be detected by A-frame 114 to which is attached conventional strain gauge 116 at one end 115 and at the other end 115*a* to the cross bar 110. In this manner, it is possible to detect the most minute deflections of the bar 110 due to the force of the bale movement. Any such deflections may either be denoted on dial 118 through lead 120 or the signals generated due to the change in force may be carried by lead 120 to previously identified controller C in FIG. 10 to modulate the flow of fluid through valve V into the ram 76. This modulation permits the maintenance of the force of the moving wall 52 constant against the bales B and thus against the picker drums or shredders 78. With a constant preselected force the volume or weight of insulation material H that is carried through the system will be uniform and thus the operator at the nozzle (not shown) will be able to spray a relatively uniform amount of insulation material onto the surface of choice.

A quantitative determinator is included to determine the amount of insulation dispensed at the dispensing end 32. To this end gear arrangement 98 in FIG. 10 includes ram rod 100 that during movement in and out from hydraulic ram 76, rotates gear 102. A position transducer may further be associated with gear arrangement 98 to provide an electrical signal proportional to the amount by which ram rod 100 is displaced from its base position within hydraulic ram 76. Although many means are known in the art for accomplishing the task of determining position by way of a transducer, two popular means are shown in FIG. 10A and FIG. 10B.

The linear position of ram rod 100 may be directly translated by way of a Linear Voltage Differential Transformer (LVDT) disposed within hydraulic ram 76 as best shown in FIG. bOA. Voltage 125 may be applied to primary windings 76A that are wound in such a manner that ram rod 100 forms core lOOA between primary windings 76A and secondary windings 76B. Motion of ram rod 100 will change the position of core lOOA and thus affect the permeability of the coupling between primary 76A and secondary 76B windings. A change in permeability affects the magnetic coupling between primary 76A and secondary 76B windings and thus varies the voltage output in proportion to movement of core bOA. Such variable voltage output may be read at analog to digital converter 126 and may be output in digital form to computer 129. Upon proper zero to full scale calibration of the LVDT, the digital output of analog to digital converter 126 will be proportional to the linear displacement of ram rod 100 from its base position to its fully extended position.

Alternatively, the linear displacement of ram rod 100 may be determined by rotary encoder 135, best shown FIG. 10B, that may be mounted within shaft support 131 shown in FIG. 10 and FIG. 10B. Gear shaft 130 for gear 102 may be provided with a magnetic element 132 that rotates directly with shaft 130. As shaft 130 rotates, element 132 moves in proximity to pick-up senors 133 disposed around the circumference of shaft 130 as it extends into the housing of rotary encoder 135. Pick-up sensors 133 provide electrical signals to signal encoder 134. Signal encoder 134 is capable of determining the direction (sign) as well as the magnitude of the movement of ram rod 100 generated based on the rotation of shaft 130. Signal encoder 134 converts rotational signals from sensors 133 into a sign-magnitude value determinative of both the direction and magnitude of linear displacement of ram rod 100 which is then readable by computer 129, or like receiving means.

As best shown in FIG. 10C, the receiving device comprises computer 129 that can be programmed by an operator using key pad 136 with various parameters such as the desired RValue of the insulated structure to be insulated, the size, usually the surface area, of the structure to be insulated, the density of the material being dispensed, the identity of the material, the size of the bale, etc. and/or other parameters. With this information computer 129 can be programmed to automatically control the dispensing of insulation or to shut down the system when an appropriate amount of insulation has been dispensed by sending an appropriate control signal to valve 127. In addition, controls for other elements of the system may be integrated into computer 129 using, for example, I/O ports 138 and 139 for sensing additional parameters and controlling additional elements. The amount actually dispensed is determined, as above set forth, by the input generated from rotary encoder 135 and the parameters stored in computer 129. In another embodiment, computer 129 is programmed to shut the blowing device down for a relatively short period of time at preselected intervals so that an operator who is dispensing insulation at a remote location can be made aware of the amount of insulation remaining in the system by reading display 137 which can be placed at any convenient location. In this manner, a remote operator can, for example, be made aware of the fact that the system has dispensed 25%, 50% and/or 75% of the total amount of insulation to be blown into a structure. programmed to shut the blowing device down for a relatively short period of time at preselected intervals so that an operator who is dispensing insulation at a remote location can be made aware of the amount of insulation remaining in the system by reading display 137 which can be placed at any convenient location. In this manner, a remote operator can, for example, be made aware of the fact that the system has dispensed 25%, 50% and/or 75% of the total amount of insulation to be blown into a structure.

The foregoing embodiment of the apparatus for installing installation from bound insulation bales performs the desired task of disengaging the insulation from the unbound bales of insulation but utilizes a substantial amount of hydraulic power to rotate the drums because of the resistance to turning the drums caused by the type of shredder utilized. During extended use the power input required to rotate the drums is a significant cost and bears upon the commerciality of the system.

Also because of the form of the abraders described above in the first embodiment, there can be no effective sizing of the length of the insulation and particularly the earlier form of the shredder may produce minute lengths of the insulation. In any event the foregoing abraders were not able to control in any respect the sizing of the insulation as it was being disengaged from the unbound insulation bales.

Other difficulties have been found to arise from the otherwise extremely effective insulation blowing machine that made a substantial advance in the art of insulation blowing. Among these problems was trying to control the amount of insulation material removed from the unbound bale. Also it was found that the insulation material tended to pack the corners of the apparatus necessitating shut down of the apparatus for more frequent cleaning than was anticipated.

Accordingly, the latest embodiment of the picker drums 78 is shown in the drawings of FIGS. 11, 12 and 13.

The picker drums 78 shown in FIGS. 11 through 13 are the same as previously described and the mechanism for rotating each picker drum about its own vertical axis 80 is also the same as previously described. The picker drums 78 are however quite different in their outer construction in view of the addition of the cutters shown generally at 150.

The cutters 150 have two different forms. For instance, the numeral 152 depicts a cutter in the form of a cutting ring 152. This cutting ring 152 has a circumferential cutting edge 154 that may or may not be a sharpened edge. The cutting ring 152 is essentially planar and perpendicular to vertical axis 80 of the picker drum. The outside cutting edge 154 is concentric to the opening 156 to surround and be fixed to the outer circumference of the picker drum 78. The other form of the cutters are the saw rings 157 having saw teeth 160.

As best shown in FIG. 12, both forms of cutters extend radially outwardly from the picker drum 78. The cutting edge 154 of the cutting ring 152 provides one of the unique features of the present invention in that it possesses the capability of slicing or severing the insulation material from the unbound bale. It should be apparent that as the unbound bale of insulation is moved forward to contact the picker drums the first contact is made by the cutters 150 that are projected into the insulation in the unbound bale by continued movement of the bales toward the cutters. Thus depending upon the vertical spacing h of cutters on the same picker drum, the sizing of the insulation may be controlled by reason of the severing of the insulation between adjacent vertically disposed cutters.

It should be also apparent that the contact of the unbound bale of insulation with the cutters permits a disengagement of the insulation from the bale with minimum resistance thus providing a requirement of hydraulic power for rotating the picker drums 78 that is significantly lower than the picker drums having the abraders.

As shown principally in FIGS. 11 and 13 the cutters 150 are in the form of first, a plurality of cutting rings 152 each having a cutting edge 154 and second a plurality of saw rings 157 having saw teeth 160. The saw rings 159 alternate vertically with the cutting rings 152 preferably in the outside picker drums 78*a* and 78*b*. Each saw ring is provided on its circumference with a plurality of teeth 160 that protrude from the circumference of the saw ring 158. These saw teeth 160 are preferably angled as shown in FIG. 13.

The direction of rotation of the picker drums is shown in FIG. 13, therefore the positioning of the saw teeth on the saw ring is for the purpose of keeping the insulation material from packing in any corners C of the apparatus. Accordingly, it is not necessary for every cutter to be provided with saw teeth 160 and, as shown in FIG. 11, only the outer picker drums 78*a* and 78*b* are recommended to have the saw rings 158 with the saw teeth 160 to prevent the insulation from packing the corners of the apparatus.

As previously stated the vertical spacing shown as dimension h in FIG. 12 controls the sizing of the insulation. Of course the sizing is variable and can be adjusted if desired although in the present presentation the spacing would be varied by original construction of the picker drums.

Another of the unique features of the present arrangement is the provision of a controller 162 that is a vertical bar secured to the circumference of the picker drums 78 and extending radially outwardly intersecting seriatim each of the cutters 150. The radial extent of the controller 162 is as shown to be less than the radial extent of the cutters. Of course each cutter is provided with an opening 164 best shown in FIG. 13 that receives the controller 162. The controller 162 is also provided with a cutout notch 166 that creates the necessary recess for clearance of the adjacent cutter to pass as best shown in FIG. 13.

However, one of the unique features of the vertical bar controller 162 is that the width shown by the dimension w in FIG. 11 controls the amount of insulation removed from the bale. This clever apportionment occurs by reason of the difference in the dimension Cw, the radial extent of the cutter ring 152, shown best in FIG. 13, and the dimension w, the radial extent of the controller 162. The cutter ring may cut the insulation to the full depth Cw of the cutter ring 152 but only that amount of insulation constituting the depth of w of the controller 162 is actually removed. Accordingly, the controller 162 establishes the amount of insulation removed.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limit ed solely by the appended claims.

We claim:

1. Apparatus for installing insulation from bound insulation bales comprising:

an elongated base for supporting said insulation bales for longitudinal movement relative to said base, said base having a dispensing end for said insulation and a distal end remote therefrom, a feeder secured to said apparatus for contacting and moving said insulation bales from said distal end toward said dispensing end, insulation bale receiving apparatus positioned at said dispensing end for disengaging said insulation from said bales, said insulation bale receiving apparatus comprising a cutter to disengage insulation from said insulation bales, said cutter comprising at least one vertically arranged member rotatable about a vertical axis toward which said bales are moved, said at least one vertically positioned member having a circumference upon which is vertically positioned a plurality of blades extending radially outwardly from said circumference for severing the insulation away from said bales, and an air blower for blowing said insulation out from said system onto a surface to be insulated.

2. The apparatus of claim 1 including, said vertically positioned member being a cylindrically shaped drum.

3. The apparatus of claim 1 including, said blades including radially extending cutting rings each said cutting ring having a circumferential cutting edge for slicing said insulation.

4. The apparatus of claim 1 including, said blades including radially extending saw rings.

5. The apparatus of claim 4 including, each said saw ring having a plurality of saw teeth extending radially outwardly for sawing said insulation.

6. The apparatus of claim 1 including, said blades including radially extending cutting rings each said cutting ring having a circumferential cutting edge for slicing said insulation, said blades including radially extending saw rings.

7. The apparatus of claim 1 including, said blades including radially extending cutting rings each said cutting ring having a circumferential cutting edge for slicing said insulation, said blades including radially extending saw rings, each said saw ring having a plurality of saw teeth extending radially outwardly for sawing said insulation.

8. The apparatus of claim 1 including, a controller extending between said blades for controlling the amount of insulation severed and removed from said bales.

9. The apparatus of claim 8 including, said controller extending vertically between said blades and being contiguous to said member.

10. The apparatus of claim 8 including, said controller extending radially outwardly from said member.

11. The apparatus of claim 8 including, said controller having a cutout notch extending substantially the depth of said controller.

12. The apparatus of claim 8 including, said controller being in the form of a vertical bar.

13. The apparatus of claim 1 including, a controller extending between said blades for controlling the amount of insulation severed and removed from said bales, said controller extending vertically between said blades and being contiguous to said member, said controller extending radially outwardly from said member.

14. The apparatus of claim 1 including, a controller extending between said blades for controlling the amount of insulation severed and removed from said bales, said controller extending vertically between said blades and being contiguous to said member, said controller extending radially outwardly from said member, said controller having a cutout notch extending substantially the depth of said controller.

15. The apparatus of claim 1 including, said blades including radially extending cutting rings each said cutting ring having a circumferential cutting edge for slicing said insulation, a controller extending between said blades for controlling the amount of insulation severed and removed from said bales.

16. The apparatus of claim 1 including, said blades including radially extending cutting rings each said cutting ring having a circumferential cutting edge for slicing said insulation, a controller extending between said blades for controlling the amount of insulation severed and removed from said bales, said controller extending vertically between said blades and being contiguous to said member.

17. The apparatus of claim 1 including, said blades including radially extending cutting rings each said cutting ring having a circumferential cutting edge for slicing said insulation, said blades including radially extending saw rings, a controller extending between said blades for controlling the amount of insulation severed and removed from said bales, said controller extending vertically between said blades and being contiguous to said member.

18. The apparatus of claim 1 including, said blades including radially extending cutting rings each said cutting ring having a circumferential cutting edge for slicing said insulation, said blades including radially extending saw rings, each said saw ring having a plurality of saw teeth extending radially outwardly for sawing said insulation, a controller extending between said blades for controlling the amount of insulation severed and removed from said bales, said controller extending vertically between said blades and being contiguous to said member.

19. The apparatus of claim 1 including, said blades including radially extending cutting rings each said cutting ring having a circumferential cutting edge for slicing said insulation, said blades including radially extending saw rings, each said saw ring having a plurality of saw teeth extending radially outwardly for sawing said insulation, a controller extending between said blades for controlling the amount of insulation severed and removed from said bales, said controller extending vertically between said blades and being contiguous to said member, said controller extending radially outwardly from said member.

20. The apparatus of claim 1 including, said blades including radially extending cutting rings each said cutting ring having a circumferential cutting edge for slicing said insulation, said blades including radially extending saw rings, each said saw ring having a plurality of saw teeth extending radially outwardly for sawing said insulation, a controller extending between said blades for controlling the amount of insulation severed and removed from said bales, said controller extending vertically between said blades and being contiguous to said member, said controller extending radially outwardly from said member, said controller having a cutout notch extending substantially the depth of said controller.

21. A method for installing insulation from bound insulation bales comprising:

supporting said bound insulation bales for longitudinal movement, unbinding said bound insulation bales to produce unbound insulation bales, moving said unbound insulation bales toward a dispensing end for contact with vertically arranged cutters, selecting the sizing of said insulation by vertically spacing said cutters, rotating said cutters, sizing and disengaging said insulation from said unbound insulation bales by cutting said insulation, directing said insulation into an air blower for dispensing said insulation.

22. The method of claim 21 including, providing blades having cutting edges to perform said cutting.

23. The method of claim 21 including, providing blades having saw teeth for sawing said insulation from said bales.

24. A method for installing insulation from bound insulation bales comprising:

unbinding said bound insulation bales to produce unbound insulation bales, moving said unbound insulation bales relative to said base toward a dispensing end for contact with vertically arranged cutters having cutting surfaces rotatable within a substantially horizontal plane, sizing and disengaging said insulation from said unbound insulation bales by cutting said insulation with said cutting surfaces, and directing said insulation into an air blower for dispensing said insulation.

25. The method of claim 24 including, controlling the sizing of said insulation, spacing said cutters vertically to effect said controlling.

26. The method of claim 24 including, providing blades having saw teeth for sawing said insulation from said bales.

27. The method of claim 24 including, controlling the sizing of said insulation, spacing said cutters vertically to effect said controlling, providing blades having saw teeth for sawing said insulation from said bales.

* * * * *